US005205351A

United States Patent [19]

Muller et al.

[11] Patent Number: 5,205,351

[45] Date of Patent: Apr. 27, 1993

[54] PROCESS FOR VAPORIZING A LIQUID, HEAT EXCHANGER THEREFOR, AND APPLICATION THEREOF TO AN APPARATUS FOR AIR DISTILLATION WITH A DOUBLE COLUMN

[75] Inventors: Christiane Muller, Jouy-en-Josas; Frëdëric Rousseau, Paris, both of France

[73] Assignee: L'Air Liquide, Societe Anonyme pour l'Etude et l'Exploitation des Procedes Georges Claude, Paris, France

[21] Appl. No.: 858,931

[22] Filed: Mar. 27, 1992

[30] Foreign Application Priority Data

Apr. 3, 1991 [FR] France ..... 91 04013

[51] Int. Cl.[5] ..... F25J 1/00

[52] U.S. Cl. ..... 165/110; 62/31; 62/34; 62/36; 62/50.2

[58] Field of Search ..... 165/110; 62/50.2, 50.5, 62/16, 31, 34, 36

[56] References Cited

U.S. PATENT DOCUMENTS

| | | | |
|---|---|---|---|
| 3,590,909 | 7/1971 | Butt | 62/36 |
| 4,380,907 | 4/1983 | Barnes | 60/50.2 |
| 4,715,433 | 12/1987 | Schwarz et al. | 62/36 |

*Primary Examiner*—Albert W. Davis, Jr.
*Attorney, Agent, or Firm*—Curtis, Morris & Safford

[57] ABSTRACT

In this process for vaporizing a liquid in first ducts, or vaporization ducts, which are opened at top and bottom, of a plate type heat exchanger, by heat exchange with a main calorigenic fluid which circulates in second ducts of the exchanger, additional gas is generated permanently in the lower end part of the first ducts, for example by means of a compartment in which there is a circulation of an auxiliary fluid which is warmer than the main calorigenic fluid. Application to the main vaporizer-condensers of apparatuses for the distillation of air with double column.

6 Claims, 1 Drawing Sheet

PROCESS FOR VAPORIZING A LIQUID, HEAT EXCHANGER THEREFOR, AND APPLICATION THEREOF TO AN APPARATUS FOR AIR DISTILLATION WITH A DOUBLE COLUMN

BACKGROUND OF INVENTION (a) Field of the Invention

The present invention relates to a process for the vaporization of a liquid in first ducts or vaporization ducts, which are substantially vertical, and are opened at the top and bottom, of a plate type heat exchanger, by heat exchange with a main calorigenic fluid which circulates downwardly in second ducts of the exchanger. The invention may be used, for example, for the vaporization of cryogenic liquid, in particular liquid oxygen at the bottom of low pressure columns of apparatuses for the distillation of air with double column.

(b) Description of Prior Art

Plate type heat exchangers, which are largely used in the apparatuses for air distillation, comprise an arrangement of a plurality of vertical rectangular plates which are made of aluminum and define therebetween a large number of flat ducts of large dimensions. Waves which are used as braces between the thermic plates and wings, are mounted between the plates. The edges of the ducts are closed by means of bar-cross-braces, and breaks therebetween enable the introduction of the fluids into the exchanger and their removal by means of semi-cylindrical inlet and outlet boxes which are fixedly mounted opposite these breaks.

Among these exchangers, some of them, so called "bath type vaporizers", include vaporization ducts which are completely opened at the top and bottom. They are currently used, for example, to vaporize liquid oxygen by condensation of mean pressure nitrogen at the bottom of low pressure columns of double columns for air distillation.

Such a bath type vaporizer is immersed in the bath of fluid to be vaporized (oxygen in this case of a double column). The circulation of this fluid is made possible by thermosiphon effect.

For a given exchanger and heat flow, the total flow which circulates in the vaporization ducts, depends on the degree of submergence, which is the ratio between the height of immersion of the exchanger in the bath of liquid and the height of the exchanger in %. This flow decreases when the submergence decreases, and the recirculation (ratio between the liquid flow at the outlet and the vaporized flow) is annulled for degrees of submergence which are too low, thus causing a drying in the upper part of the vaporizer.

In certain cases, and for example in the above mentioned oxygen vaporizers, such an operation under dry condition is not permitted, for safety reasons. As a matter of fact, there is a risk of deposit and concentration of hydrocarbons which may react with oxygen to cause an explosion. One is therefore forced to operate with relatively high submergences, generally of the order of 70 to 80%.

This is detrimental on the point of view of the performance of the exchanger, since the hydrostatic height of the bath of liquid results in a sub-cooling of the liquid at the bottom of the exchanger, this sub-cooling reaches for example 0.8° C. for a height of liquid oxygen of 1 meter in a low pressure column operating under 1.3 bar absolute. The lower part of the vaporizer is therefore used to warm this liquid and to bring it to its boiling point, and this zone may reach an important fraction of the height of the vaporizer ($\frac{1}{3}$ to $\frac{1}{4}$ for a submergence of 100%).

Under these conditions, it is difficult to operate a bath type oxygen vaporizer with a small temperature gap lower than 1° C. between oxygen and means pressure nitrogen, unless the height of the vaporizer is reduced and exchangers placed in superposed baths are mounted at the bottom of the column. This solution has already been used with certain apparatuses, however it represents a costly investment.

SUMMARY OF INVENTION

The invention aims at enabling to reduce the submergence without causing dryness in the upper part of the vaporization ducts.

For this purpose, according to a characteristic of the invention, additional gas is continuously generated in the lower end part of said first ducts.

According to other characteristics of the invention:

a flow of gas, which originates from a source of gas outside the exchanger, is continuously injected into the liquid which is present in said lower end part;

for the vaporization of a pure substance in liquid state, said gas consists of the same pure substance in gaseous state;

an auxiliary fluid which is warmer than said main calorigenic fluid is circulated in the lower end part of the exchanger, in heat exchange relationship with the lower end part of the first ducts;

for the vaporization of liquid oxygen in the main vaporizer-condenser of an apparatus for distillation of air with double column, the hot auxiliary flow consists of rich liquid from the bottom of the mean pressure column of the double column, air at mean pressure or air at low pressure which comes from an expansion turbine of the apparatus.

It is also an object of the invention to provide a heat exchanger intended for working such a process.

This plate type exchanger, comprising first ducts, or vaporization ducts, which are substantially vertical, are opened at the top and bottom, and with smooth configuration, and second ducts for the circulation of a main calorigenic fluid, is characterized in that includes means for continuously generating an additional gas in the lower end part of the first ducts.

According to a characteristic of the invention, the generating means comprise means for injecting said gas in the lower part of the first ducts.

According to another characteristic of the invention, the generating means consist of at least one compartment for the circulation of an auxiliary fluid which is warmer than said main calorigenic fluid, which extends the lower end part of said second cuts, opposite that of the first ducts.

It is also an object of the invention to provide an apparatus for air distillation with double column which comprises a main vaporizer-condenser consisting of a heat exchanger such as defined above, disposed at the bottom of the low pressure column of the double column, and means for circulating mean pressure nitrogen through said second ducts.

BRIEF DESCRIPTION OF DRAWINGS

The embodiments of the invention will now be described with reference to the annexed drawings, in which.

DESCRIPTION OF PREFERRED EMBODIMENTS

Figure 1:
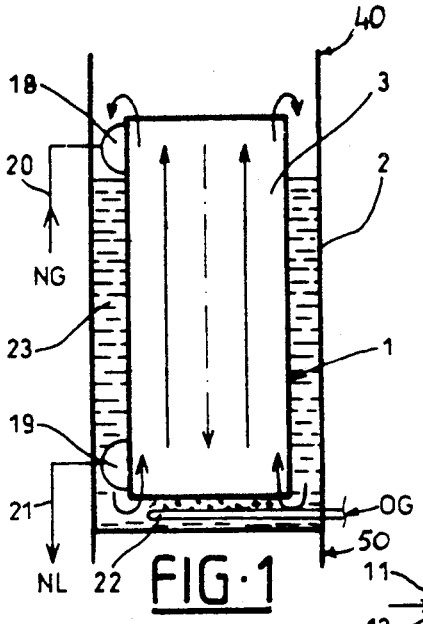
FIG. 1 is a schematic view in elevation of a first heat exchanger according to the invention.

There is schematically illustrated in FIG. 1 a heat exchanger 1 of the type with brazed plates, constituting the main vaporizer-condenser of a double column for the distillation of air and mounted in the vat 2 of the low pressure column 40 which surmounts the mean pressure column 50 of this double column.

The exchanger 1, generally parallelipedic, consists of a large number of vertical rectangular aluminum plates 3, defining two series of ducts therebetween, which, for example, alternate: first ducts 4, or ducts for the vaporization of liquid oxygen, and seconds ducts 5, or ducts for the condensation of nitrogen.

Each duct 4 (FIG. 2) is opened at the top and bottom and is closed on both sides, along its entire height, by means of bar-cross-braces 4A. It contains a wave 6 with vertical generatrices, which may be perforated, and which extends along the entire height of the duct 4 and simultaneously serves as a cross-brace and heat fin.

Each duct 5 (FIG. 3) includes along essentially its entire height, lateral closing bar-cross-braces 5A and a wave 7 with vertical generatrices similar to waves 6. It has a zone 8 for the inlet of gaseous nitrogen at its upper end and a zone 9 for the outlet of liquid nitrogen at its lower end. Zone 8 is closed at the top and on one side 10 on bar-cross-braces 8A and is opened on the other side by means of an inlet window 11. It contains a distributing wave comprising a first wave 12 with descending oblique generatrices, directly opening on the upper end of wave 7, along the entire width (i.e. the horizontal dimension) of duct 5.

Similarly, the outlet zone is closed at the bottom and on one side 14 by means of bar-cross-braces 9A and is opened at the other side on an outlet window 15. It contains an oblique wave 16 on which wave 7 directly opens, along the entire width of duct 5, and a horizontal wave 17 opening on window 15.

The plates, waves and bar-cross-braces have smooth surfaces, which are free from roughness or cavities. The unit consisting of the plates, waves and bar-cross-braces is sealingly joined together by oven brazing, and semi-cylindrical boxes 18, 19 for the inlet and outlet of nitrogen are laterally mounted by welding on the exchanger, opposite windows 11 and 15. These boxes are respectively connected at the top of the mean pressure column (not illustrated) of the double column by means of ducts 20, 21.

Perforated ramps 22 connected to a source of oxygen (not illustrated) are mounted below exchanger 1 at the bottom of column 2, and preferably immediately below each vaporization duct 4, with perforations distributed along the entire width of the latter. As a variant, as indicated in mixed line in FIG. 2, wave 6 may, in each duct 4, be stopped near the bottom of the exchanger, and ramp 22 may be mounted in the space thus released at the lower end of the duct.

In operation, the exchanger 1 is partially immersed in the bath of liquid oxygen 23 formed at the bottom of column 2. Gaseous nitrogen under a means pressure of about $6\times10^5$ Pa absolute circulates through ducts 5, via box 18, waves 12, 13, 7, 16 and 17, while being condensed, and exits therefrom in liquid form via box 19. By condensing, this nitrogen produces a vaporization of the liquid oxygen contained in ducts 4, and the oxygen circulates upwardly by thermosiphon effect through these ducts, while containing an increasing proportion of gas. A two-phase mixture of liquid oxygen/gaseous oxygen exits at the top of ducts 4 and falls again in bath 23, as schematically illustrated by means of the arrows in FIG. 1, where the descending circulation of nitrogen has also been schematically illustrated by means of an arrow in mixed line.

Through the continuous injection of a flow of gaseous oxygen at the bottom of ducts 4 by means of ramps 22, the rising flow of oxygen is permanently in two-phase already at the lower end of these ducts, which improves heat exchange between oxygen and nitrogen. Moreover, the recirculation is increased and thereafter, a reduced submergence may be adopted without the risk of drying the upper zone of the ducts 4, which finally results in a lesser sub-cooling of the liquid oxygen which is present in the exchanger 1. In total, the performances of the vaporizer-condenser are substantially improved, and the temperature of the calorigenic gasous nitrogen and therefore the operating pressure (i.e. mean pressure) of the apparatus for air distillation may be reduced. The flow of gaseous oxygen introduced via ramps 22 is of the order of 2 to 4% of the flow of vaporized oxygen.

Figure 3:
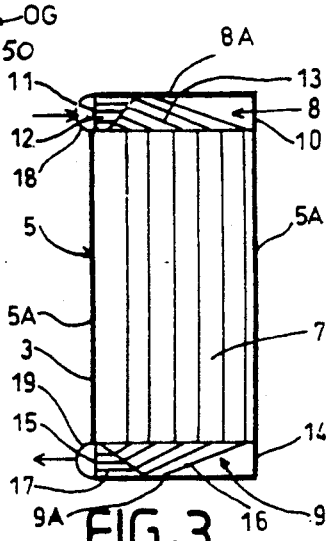
FIG. 3 is a view of the same exchanger, taken in vertical cross-section in a duct for the circulation of calorigenic fluid.
Figure 4:
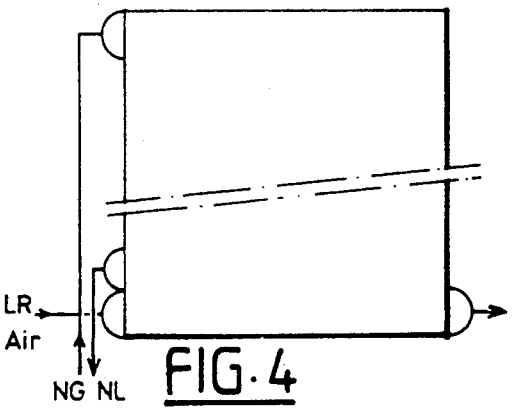
FIG. 4 is a schematic view in elevation of a second heat exchanger according to the invention.
Figure 5:
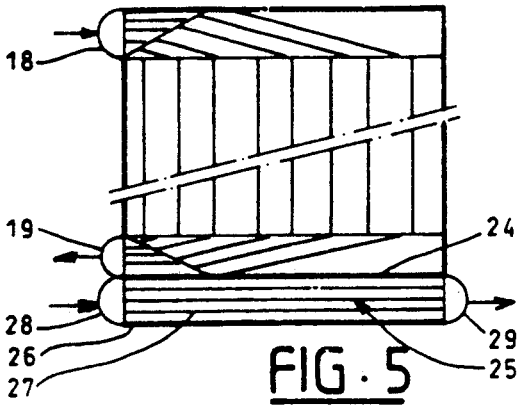
FIG. 5 is a view similar to FIG. 3 of the exchanger of FIG. 4.

In the embodiment of FIGS. 4 and 5, which is advantageous on an energy point of view, the additional gaseous oxygen (with respect to the one generated by heating with means pressure nitrogen) is generated in situ at the lower end of ducts 4. The latter are identical to those of FIG. 2, the ramps 22 are removed, and the ducts 5 of FIG. 3 are slightly shortened at the bottom, i.e. they are closed towards the bottom by means of a bar-cross-brace 24 located near the lower end of the exchanger. Below this bar there is provided a compartment 25 which is closed at the bottom by means of a bar-cross-brace 26, opened on both sides and containing along its entire length a wave 27 with horizontal generatrices.

In operation, an auxiliary fluid which is warmer than mean pressure nitrogen circulates continuously through compartment 25, in which it penetrates via inlet box 28 and from which it exits via outlet box 29. The temperature and the flow of this fluid are selected to permanently produce an appearance of sufficient vaporization of oxygen in this region. For example the auxiliary fluid may be selected from:

"rich liquid" (oxygen enriched air) withdrawn at the bottom of the mean pressure column, and which will be sub-cooled in compartments 25;

mean pressure air, which will be liquefied in these compartments; or low pressure air which exits from an expansion turbine and is intended to be blown into the low pressure column, when the temperature of the air at the outlet of the turbine is sufficient.

As a variant, compartment 25 may be replaced by a plurality of superposed compartments, thus enabling to use a plurality of auxiliary fluids.

Also as a variant, compartment 25 may be subdivided so as to constitute a plurality of superposed passages, connected in series, to increase the speed of flow of the auxiliary fluid and, improve its heat exchange coefficient.

Figure 2:
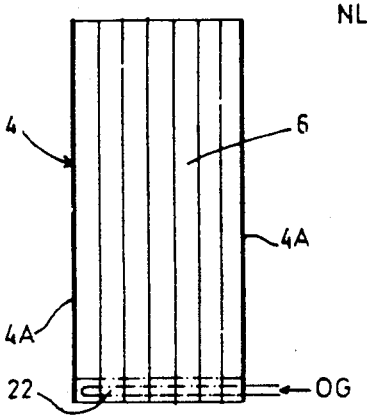
FIG. 2 is a view of this exchanger, taken in vertical cross-section in a vaporization duct.

Still as a variant, the embodiment of FIGS. 4 and 5 may be used also for injecting gaseous oxygen into vaporization ducts 4, as in FIGS. 1 to 3. To do this, the gaseous oxygen is introduced into compartments 25 via box 28, box 29 is replaced by closure bars, and the plates 3 are perforated along compartments 25 to enable the passage of gaseous oxygen of these compartments into vaporization ducts 4. In this case, it is preferable to remove waves 27.

We claim:

1. A process of boiling a liquefied first fluid in a condenser-reboiler having substantially vertical first and second passages in heat exchange relationship, the first passages having an open lower end and having smooth surfaces, comprising the steps of partially immersing the condenser-reboiler in a bath of said liquefied first fluid so as to have a lower portion of the first passages in the lower end, not exceeding a predetermined extent, immersed within said liquefied first fluid, passing a second fluid, initially in a gaseous state, downwardly through the second passages and continuously introducing a gaseous flow of said first fluid into said lower portion of the first passages to establish permanently a two-phase rising flow of the first fluid all along the lower portion of the first passages, thereby reducing subcooling of the first liquefied fluid in the lower portion of the first passages.

2. The process of claim 1, wherein the step of continuously introducing a gaseous flow of said first fluid into said lower portion of the first passages comprises continuously injecting a flow of said first fluid in a gaseous state into the lower end of the first passages.

3. The process of claim 1, wherein the step of continuously introduced a gaseous flow of said first fluid into said lower portion of the first passages comprises continuously causing part of said liquefied first fluid in the bath to evaporate adjacent the lower end of the first passages.

4. The process of claim 3, wherein said part of the liquefied first fluid is brought into indirect heat exchange relation with a permanent flow of a third fluid warmer than the second fluid.

5. The process of claim 4, wherein the condenser-reboiler is partially immersed in a low pressure column which surmounts a mean pressure column in a cryogenic air-distillation assembly wherein the third fluid is selected from the group consisting of rich liquid from a bottom portion of the mean pressure column, air at the pressure of the low pressure column and expanded feed air.

6. The process of claim 1, wherein the first fluid is oxygen.

* * * * *

UNITED STATES PATENT AND TRADEMARK OFFICE

CERTIFICATE OF CORRECTION

PATENT NO. : 5,205,351

DATED : April 27, 1993

INVENTOR(S) : Christiane Muller and Frederic Rousseau

It is certified that error appears in the above-identified patent and that said Letters Patent is hereby corrected as shown below:

Claim 3, line 2 (column 6, line 12), change "introduced" to --introducing--.

Signed and Sealed this

Twenty-eighth Day of December, 1993

*Attest:*

Bruce Lehman

BRUCE LEHMAN

*Attesting Officer*

*Commissioner of Patents and Trademarks*